US009935401B2

(12) United States Patent
Tsai et al.

(10) Patent No.: US 9,935,401 B2
(45) Date of Patent: Apr. 3, 2018

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long-Fei Chen, New Taipei (TW); Hsin-Hung Chen, New Taipei (TW); Rui Su, New Taipei (TW); Chien-Tsung Chuang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/398,013

(22) Filed: Jan. 4, 2017

(65) Prior Publication Data

US 2017/0194745 A1 Jul. 6, 2017

(30) Foreign Application Priority Data

Jan. 4, 2016 (CN) ..... 2016 2 0001307 U

(51) Int. Cl.

| | |
|---|---|
| ***H01R 13/648*** | (2006.01) |
| ***H01R 13/652*** | (2006.01) |
| ***H01R 13/6594*** | (2011.01) |
| ***H01R 24/60*** | (2011.01) |
| ***H01R 13/405*** | (2006.01) |
| ***H01R 13/6582*** | (2011.01) |
| ***H01R 13/6586*** | (2011.01) |
| *H01R 107/00* | (2006.01) |
| *H01R 12/71* | (2011.01) |

(52) U.S. Cl.

CPC ..... *H01R 13/652* (2013.01); *H01R 13/405* (2013.01); *H01R 13/6582* (2013.01); *H01R 13/6586* (2013.01); *H01R 13/6594* (2013.01); *H01R 24/60* (2013.01); *H01R 12/716* (2013.01); *H01R 2107/00* (2013.01)

(58) Field of Classification Search

CPC ..... H01R 13/652
USPC ..... 439/60
See application file for complete search history.

(56) References Cited

U.S. PATENT DOCUMENTS 8,475,218 B2 * 7/2013 Zheng ..... G02B 6/3817 439/660
9,088,108 B2 * 7/2015 Zhao ..... H01R 13/6581
(Continued)

*Primary Examiner* — Tulsidas C Patel
*Assistant Examiner* — Peter G Leigh
(74) *Attorney, Agent, or Firm* — Muncy, Geissler, Olds & Lowe, P.C.

(57) ABSTRACT

An electrical receptacle connector includes an insulated member received in a metallic shell. First and second receptacle terminals are held in the insulated member. A shielding plate is between the first and second receptacle terminals. The metallic shell includes a shell body and a contact arm. The metallic shell includes a receptacle cavity for receiving the insulated member. The contact arm includes a supporting portion extending outward from the shell body, and a plurality of contact surfaces extending from the supporting portion. The contact arm is in contact with an inner wall of a housing of an electronic device, and the contact surfaces are conducted with the inner wall of the housing of the electronic device, thereby improving the performance of electromagnetic compatibility.

14 Claims, 12 Drawing Sheets

(56) References Cited

U.S. PATENT DOCUMENTS

| | | | | |
|---|---|---|---|---|
| 9,093,797 | B2 * | 7/2015 | Zhao | H01R 12/707 |
| 9,106,024 | B2 * | 8/2015 | Zhao | H01R 13/6581 |
| 9,214,766 | B1 * | 12/2015 | Yu | H01R 13/6585 |
| 2010/0267261 | A1 * | 10/2010 | Lin | H01R 13/6461<br>439/218 |
| 2010/0303421 | A1 * | 12/2010 | He | G02B 6/3817<br>385/75 |
| 2014/0073184 | A1 * | 3/2014 | Zhao | H01R 13/6594<br>439/607.55 |
| 2014/0187105 | A1 * | 7/2014 | Zhao | H01R 12/707<br>439/733.1 |
| 2015/0087165 | A1 * | 3/2015 | Yu | H01R 12/724<br>439/78 |
| 2015/0171574 | A1 * | 6/2015 | Little | H01R 24/60<br>439/78 |
| 2015/0194768 | A1 * | 7/2015 | Little | H01R 13/6594<br>439/607.37 |
| 2015/0194770 | A1 * | 7/2015 | Little | H01R 13/6582<br>439/607.27 |
| 2015/0194772 | A1 * | 7/2015 | Little | H01R 13/6597<br>439/357 |
| 2015/0222059 | A1 * | 8/2015 | Little | H01R 13/6587<br>439/607.55 |
| 2015/0229077 | A1 * | 8/2015 | Little | H01R 12/724<br>439/78 |
| 2015/0244111 | A1 * | 8/2015 | Ju | H01R 13/6585<br>439/607.05 |
| 2015/0340791 | A1 * | 11/2015 | Kao | H01R 24/60<br>439/676 |
| 2015/0364883 | A1 * | 12/2015 | Yu | H01R 24/70<br>439/607.27 |

* cited by examiner

| | | | | | | | | | | | | | | | | |
|---|---|---|---|---|---|---|---|---|---|---|---|---|---|---|---|---|
| GND | TX1+ | TX1− | VBUS | CC1 | D+ | D− | SBU1 | VBUS | RX2− | RX2+ | GND | 31 |
| GND | RX1+ | RX1− | VBUS | SBU2 | D− | D+ | CC2 | VBUS | TX2− | TX2+ | GND | 41 |

FIG.5

ELECTRICAL RECEPTACLE CONNECTOR

CROSS-REFERENCE TO RELATED APPLICATION

This non-provisional application claims priority under 35 U.S.C. § 119(a) to Patent Application No. 201620001307.8 filed in China, P.R.C. on Jan. 4, 2016, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. The plastic core of the conventional connector is an assembly of several plastic pieces, and the upper and lower receptacle terminals are respectively combined with the plastic pieces.

SUMMARY OF THE INVENTION

However, when the conventional USB type-C electrical connector is assembled in a housing of an electronic device, the outer shell of the connector does not contact the housing. Therefore, electromagnetic compatibility (EMC) of the connector cannot be improved. Therefore, how to solve the aforementioned problem is an issue.

In view of this, an embodiment of the instant disclosure provides an electrical receptacle connector. The electrical receptacle connector comprises a terminal module, a shielding plate, and a metallic shell. The terminal module comprises a plurality of first receptacle terminals, a plurality of second receptacle terminals, and an insulated member. The first receptacle terminals, the second receptacle terminals, and the insulated member are integrally formed as a whole. A tongue portion is extending from one end of the insulated member. Each of the first receptacle terminals comprises a first flat contact portion on one of two opposite surfaces of the tongue portion. Each of the second receptacle terminals comprises a second flat contact portion on the other surface of the tongue portion. The shielding plate is in the insulated member and between the first flat contact portions and the second flat contact portions. The metallic shell comprises a shell body and a contact arm. The metallic shell comprises a receptacle cavity for receiving the terminal module. The contact arm comprises a supporting portion extending outward from the shell body and a plurality of contact surfaces extending from the supporting portion.

In one embodiment, the shell body comprises an inner shell and a cover plate. The inner shell is a tubular member and fitted over the terminal module. The inner shell comprises an insertion opening communicating with the receptacle cavity. The cover plate covers the inner shell, and the contact arm is on one side of the cover plate. In addition, the supporting portion is extending outward from an end edge of the insertion opening or an end edge of the cover plate. The contact surfaces are bent outward from two sides of the supporting portion.

In one embodiment, the electrical receptacle connector further comprises a plurality of contact arms. The contact arms are spacedly aligned on an end edge of the insertion opening or an end edge of the cover plate.

In one embodiment, the electrical receptacle connector further comprises a plurality of contact arms spacedly aligned on an outer surface of the cover plate. The supporting portions of the contact arms are bent outward from the outer surface of the cover plate or an end edge of the cover plate.

Another embodiment of the instant disclosure provides an electrical receptacle connector. The electrical receptacle connector comprises a terminal module, a shielding plate, and a metallic shell. The terminal module comprises a plurality of first receptacle terminals, a plurality of second receptacle terminals, an insulated member, and a plurality of buckling grooves. The first receptacle terminals, the second receptacle terminals, and the insulated member are integrally formed as a whole. A tongue portion is extending from one end of the insulated member. Each of the first receptacle terminals comprises a first flat contact portion on one of two opposite surfaces of the tongue portion. Each of the second receptacle terminals comprises a second flat contact portion on the other surface of the tongue portion. The buckling grooves are formed at two sides of the insulated member. The shielding plate is in the insulated member and between the first flat contact portions and the second flat contact portions. The shielding plate comprises a plurality of contact parts respectively extending toward the buckling grooves and a plurality of legs respectively extending outward from the contact parts. The metallic shell comprises a shell body and a plurality of buckling sheets. The metallic shell comprises a receptacle cavity for receiving the terminal module. Each of the buckling sheets comprises an extension portion and a contact sheet. The extension portions are extending toward the buckling grooves from two sides of the shell body. The contact sheets are extending toward the buckling grooves from the extension portions, respectively. The contact sheets are in contact with the contact parts, respectively.

In one embodiment, the electrical receptacle connector further comprises a circuit board. The circuit board comprises a plurality of contacts. The metallic shell comprises a plurality of conductive legs extending outward from two sides of the shell body and connected to the contacts, respectively; or the legs are connected to the contacts. In addition, the metallic shell further comprises a plurality of extension sheets extending outward from the two sides of the shell body and attached on a surface of the circuit board.

In one embodiment, the metallic shell further comprises a guiding portion surrounding an end edge of the insertion opening. The guiding portion is bent and extending outward. Moreover, the metallic shell further comprises a rear cover, two ear portions, and two engaging sheets. The two engaging sheets are extending outward from two sides of the shell body. The two ear portions are extending from two sides of the rear cover, bent, and engaged with the two engaging sheets.

As above, the contact arms are in contact with the inner wall of the housing, and the contact arms have a force adapted to maintain the contact after the contact arms are in contact with the inner wall of the housing, so that the contact surfaces are conducted with the inner wall of the housing of the electronic device for grounding, thereby improving the performance of electromagnetic compatibility. Furthermore, the metallic shell comprises the conductive legs extending outward from two sides of the shell body and respectively connected to the contacts of the circuit board. The metallic shell may be electrically connected to an electrical plug connector and the connection can be grounded by the housing and the circuit board. Moreover, when the metallic shell encloses the insulated member, the contact sheets are bent, so that the angle between each of the contact sheets and the corresponding contact portion is approximately 90 degrees. Hence, the contact sheets are engaged with the buckling grooves for positioning the insulated member, so that the insulated member does not detach from the metallic shell. Additionally, the contact sheets are in contact with the legs, and end portions of the legs are soldered with the circuit board for grounding, thereby improving the performance of electromagnetic compatibility.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 5 illustrates a schematic configuration diagram of the receptacle terminals of the electrical receptacle connector shown in FIG. 3;

DETAILED DESCRIPTION

Figure 1:
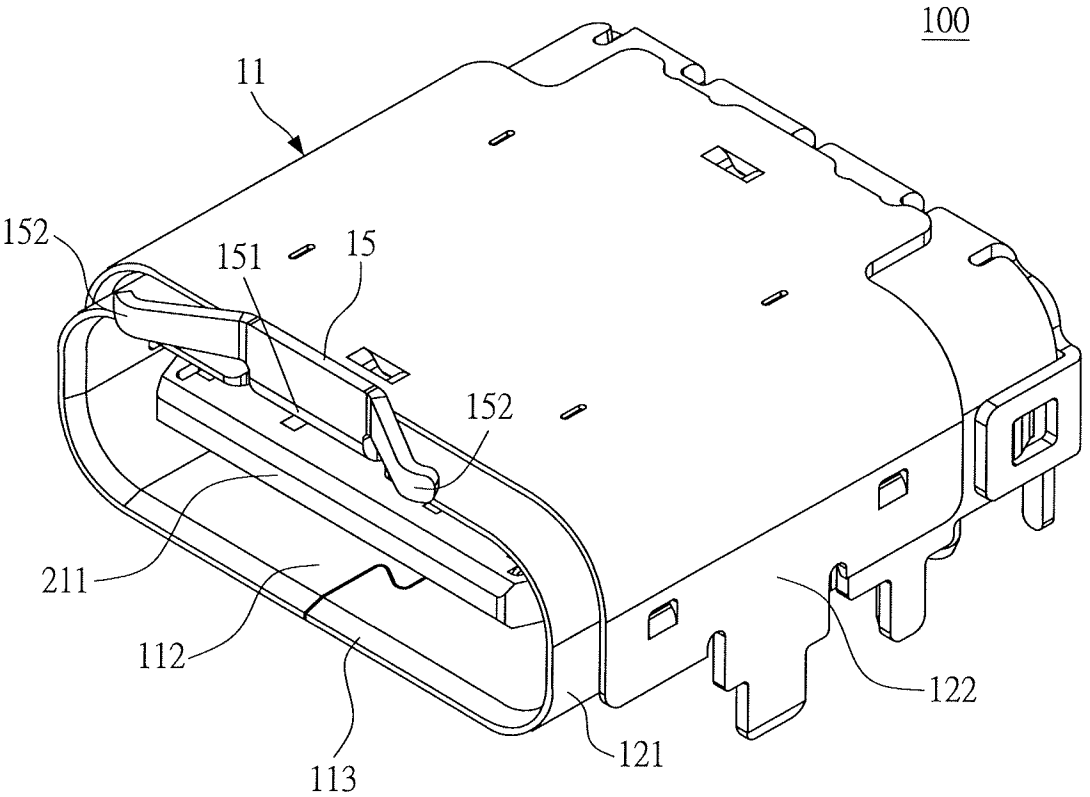
FIG. 1 illustrates a perspective view of an electrical receptacle connector of a first embodiment of the instant disclosure.
Figure 2:
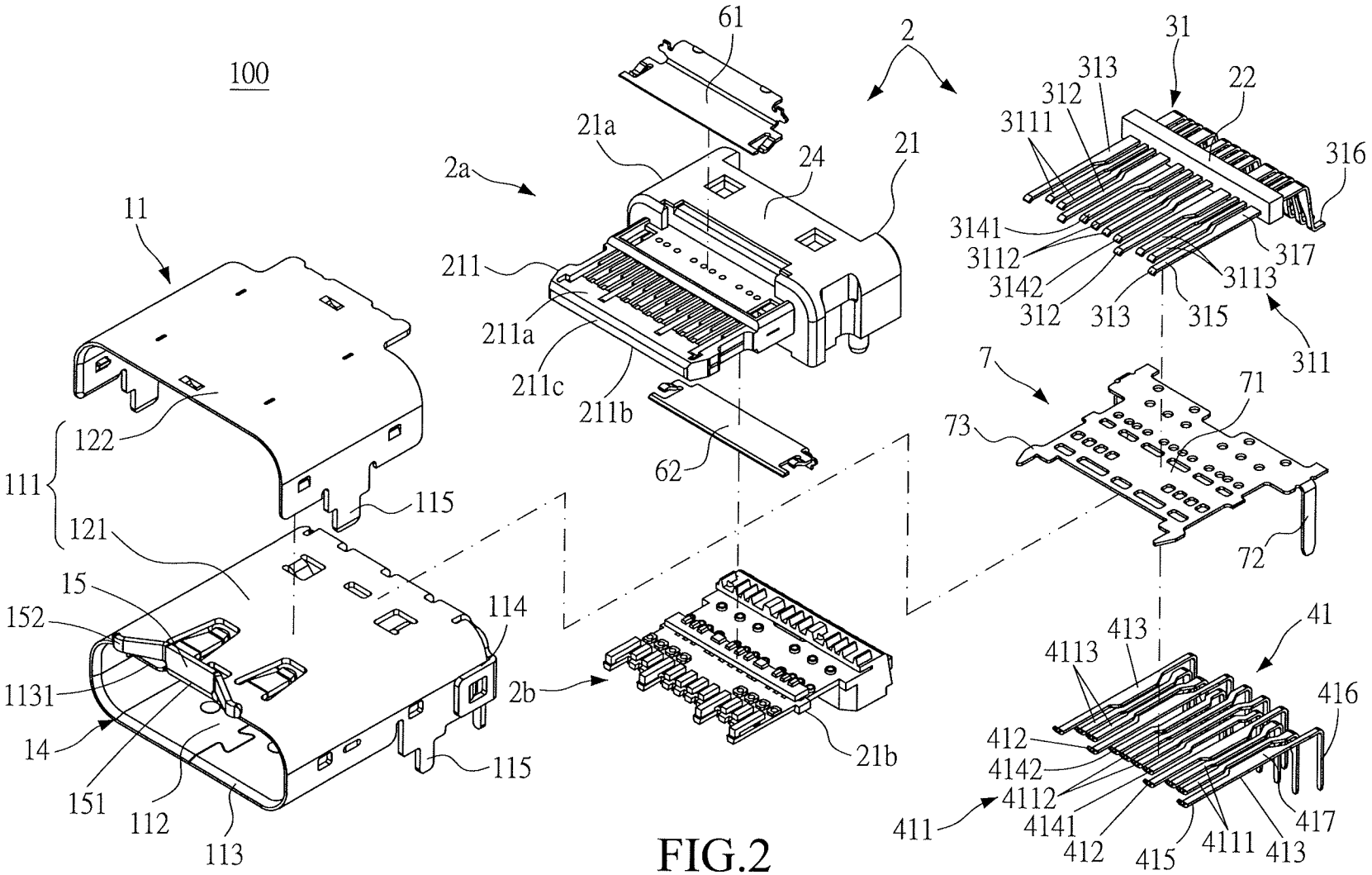
FIG. 2 illustrates an exploded view of the electrical receptacle connector of the first embodiment.
Figure 3:
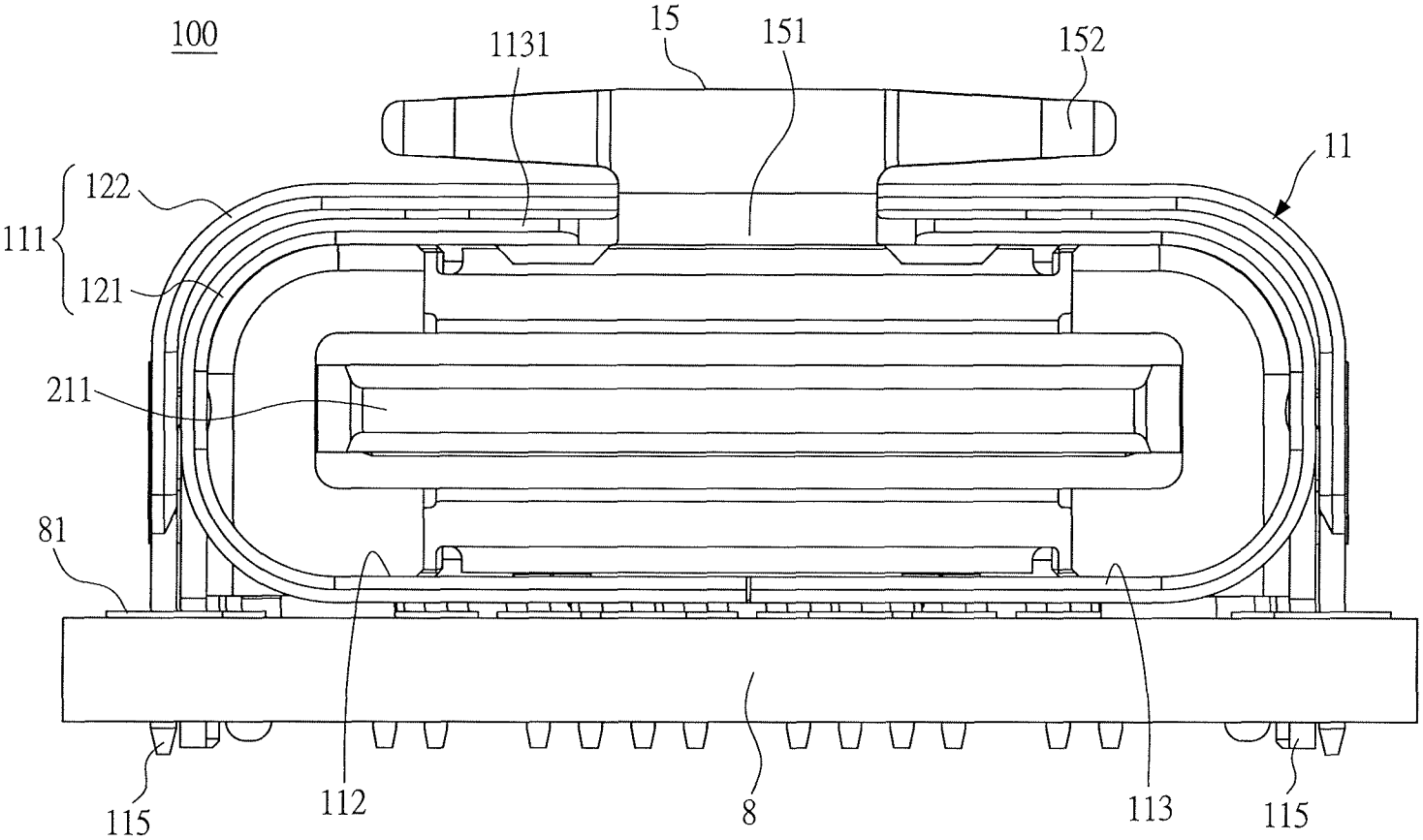
FIG. 3 illustrates a front view of the electrical receptacle connector of the first embodiment.

Please refer to FIGS. 1 to 3, illustrating an electrical receptacle connector of a first embodiment of the instant disclosure. FIG. 1 illustrates a perspective view of an electrical receptacle connector of the first embodiment of the instant disclosure. FIG. 2 illustrates an exploded view of the electrical receptacle connector of the first embodiment. FIG. 3 illustrates a front view of the electrical receptacle connector of the first embodiment. In this embodiment, the electrical receptacle connector 100 is mounted on a circuit board 8. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a terminal module 2, a shielding plate 7, and a metallic shell 11.

Please refer to FIGS. 1 to 3. In this embodiment, the metallic shell 11 is a hollowed shell, and the metallic shell 11 comprises a shell body 111 and a contact arm 15. The metallic shell 11 comprises a receptacle cavity 112 formed therein and defined through the shell body 111, and the receptacle cavity 112 is provided for receiving the terminal module 2. In this embodiment, the shell body 111 is an inner shell 121 and the electrical receptacle connector 100 further comprises a cover shell 122. The inner shell 121 may be a tubular member and circularly encloses the terminal module 2. An insertion opening 113 with oblong shaped is formed on one of two opposite ends of the inner shell 121, a rear opening 114 with oblong shaped is formed on the other end of the inner shell 121, and the insertion opening 113, the rear opening 114, and the receptacle cavity 112 are in communication with each other. Furthermore, the metallic shell 11 further comprises a guiding portion 117 (as shown in FIG.

10). In this embodiment, the guiding portion 117 is bent and extending outward from an end edge 1131 of the insertion opening 113, and the guiding portion 117 surrounds the opening of the inner shell 121. Therefore, the guiding portion 117 facilitates the insertion of an electrical plug connector into the receptacle cavity 112.

Figure 6B:
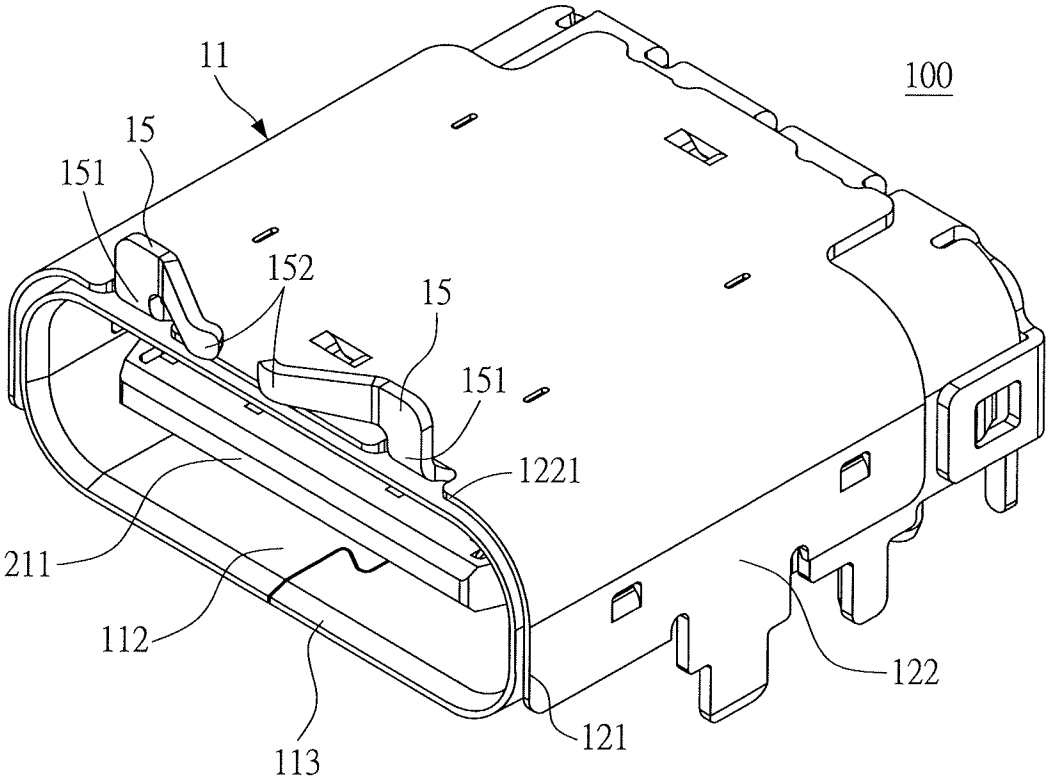
FIG. 6B illustrates a perspective view of one embodiment of the contact arms of the electrical receptacle connector of the second embodiment.
Figure 7A:
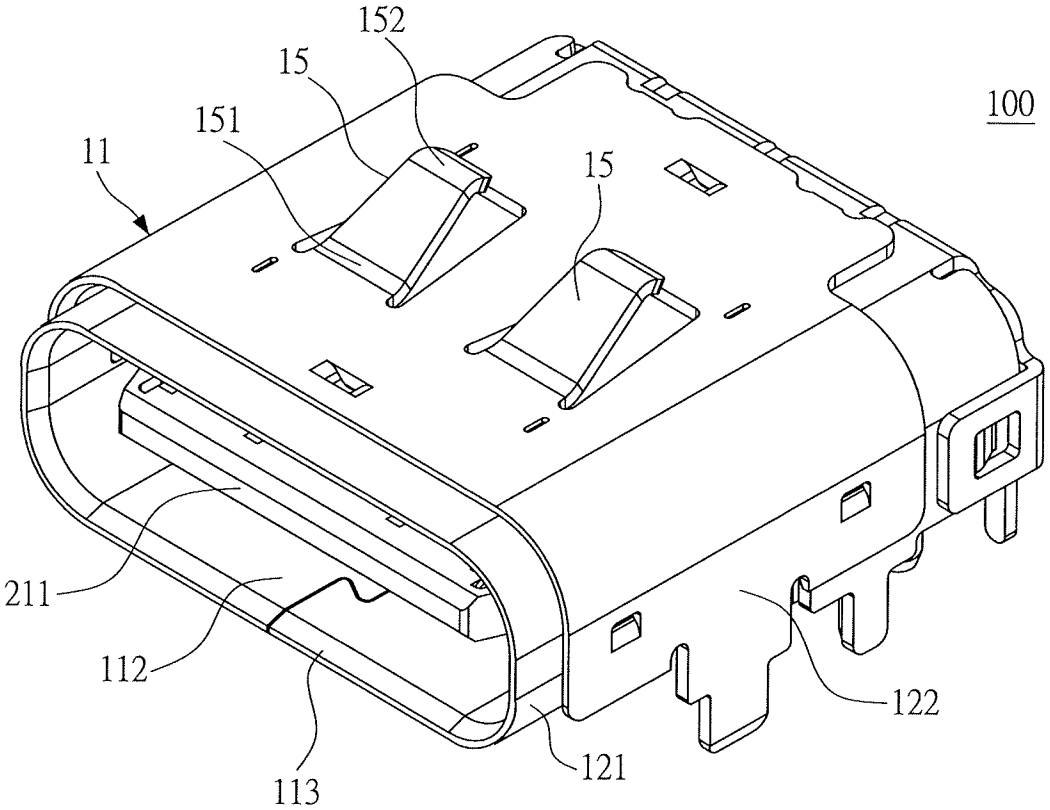
FIG. 7A illustrates a perspective view of an electrical receptacle connector of a third embodiment of the instant disclosure.
Figure 7B:
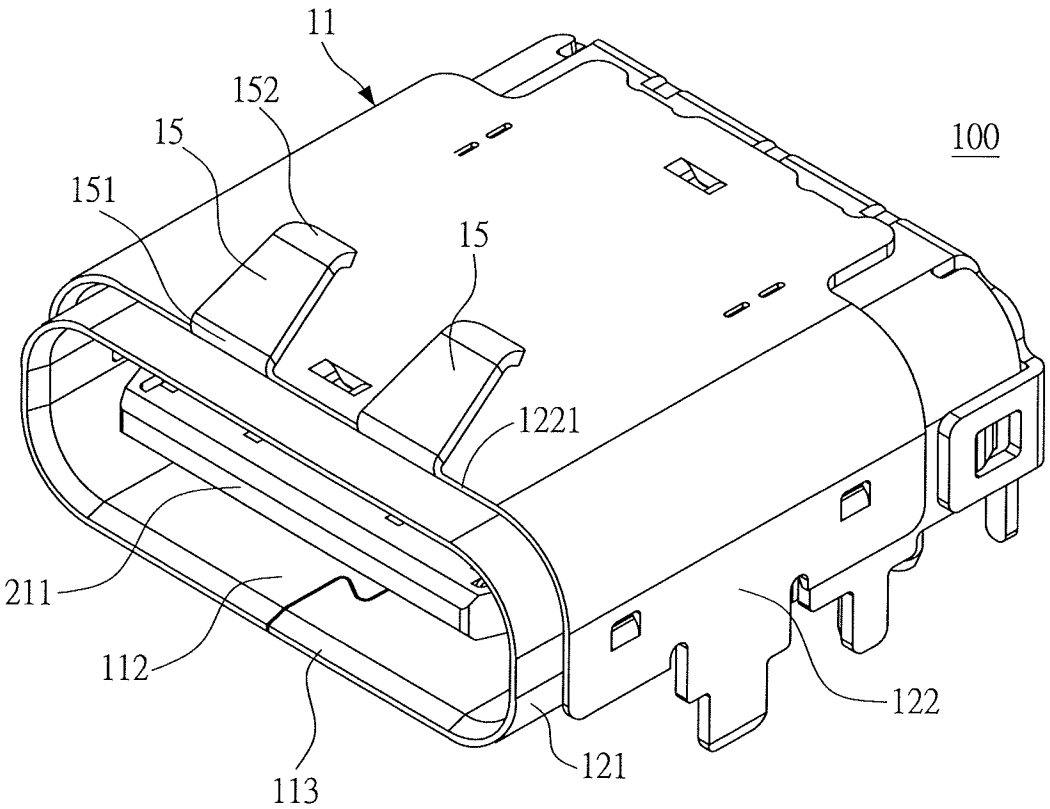
FIG. 7B illustrates a perspective view of one embodiment of the contact arms of the electrical receptacle connector of the third embodiment.

In addition, the cover shell 122 covers the inner shell 121. In this embodiment, the cover shell 122 is a semi-tubular member having a U-shape cross section, and the semi-tubular member covers the top and the two sides of the inner shell 121 and provided as an outer shell. Furthermore, the contact arm 15 is on the inner shell 121 (as shown in FIGS. 1 and 3), but embodiments are not limited thereto. Alternatively, the contact arm 15 may be on one side of the cover shell 122 (as shown in FIGS. 6B, 7A, and 7B). Moreover, in one embodiment, the shell body 111 may be a unitary piece and is a single shell.

Figure 4:
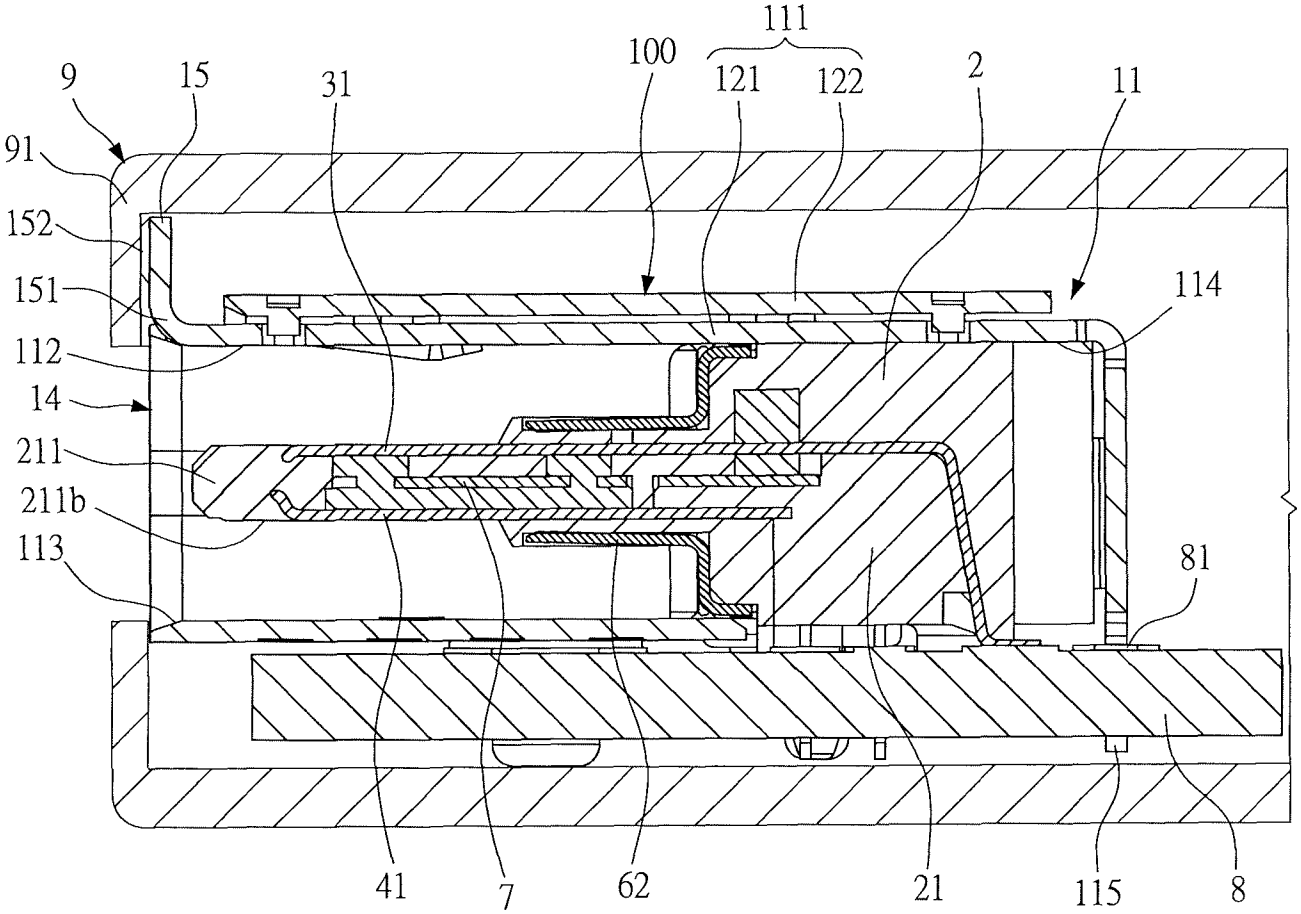
FIG. 4 illustrates a lateral view showing that the electrical receptacle connector of one embodiment of the instant disclosure is assembled in a housing of an electronic device.

Please refer to FIGS. 1, 2, and 4. FIG. 4 illustrates a lateral view showing that the electrical receptacle connector of one embodiment of the instant disclosure is assembled in a housing of an electronic device. In this embodiment, the contact arm 15 is a flexible arm. The contact arm 15 comprises a supporting portion 151 extending outward from the shell body 111 and a plurality of contact surfaces 152 extending from the supporting portion 151. The contact surfaces 152 are bent and exposed outward. The supporting portion 151 is the pivoting center of the contact arm 15 when the contact arm 15 is swinging. The contact surfaces 152 are bent outward from two sides of the supporting portion 151 and the two contact surfaces 152 are extended toward different directions, respectively. In addition, each of the contact surfaces 152 is a curved surface and can be in contact with a housing 91 of an electronic device 9 conveniently. Furthermore, the contact surface 152 is spaced from an outer surface or the sides of the shell body 111 by a certain interval. Depending on the size of the housing 91, the interval can be determined in advance. Therefore, when the connector is assembled in the housing 91 of the electronic device 9, the contact surfaces 152 are in contact with the housing 91 of the electronic device 9.

Please refer to FIGS. 1, 2, and 4. When the electrical receptacle connector 100 is assembled in the housing 91 of the electronic device 9 (e.g., a mobile phone or a notebook computer), the contact arm 15 is in contact with an inner wall of the housing 91, and the contact arm 15 has a force adapted to maintain the contact after the contact arm 15 is in contact with the inner wall of the housing 91, and the contact arm 15 are conducted with the inner wall of the housing 91 for grounding, thereby improving the performance of electromagnetic compatibility (EMC). Furthermore, the electrical receptacle connector 100 may be soldered on a circuit board 8. The circuit board 8 comprises a plurality of contacts 81. The metallic shell 11 comprises a plurality of conductive legs 115 extending outward from two sides of the shell body 111 and connected to the contacts 81, respectively. The metallic shell 11 may be electrically connected to an electrical plug connector and the connection can be grounded by the housing 91 and the circuit board 8.

Please refer to FIGS. 1, 2, and 4. The terminal module 2 comprises a plurality of first receptacle terminals 31, a plurality of second receptacle terminals 41, and an insulated member 21. The first receptacle terminals 31, the second receptacle terminals 41, and the insulated member 21 are integrally formed as a whole. In other words, a single insulated member 21 is assembled with the first receptacle terminals 31 and the second receptacle terminals 41. Furthermore, a tongue portion 211 is extending from one end of the insulated member 21. Each of the first receptacle terminals 31 comprises a flat contact portion 315 on one of two opposite surfaces (i.e., a first surface) of the tongue portion 211. Each of the second receptacle terminals 41 comprises a flat contact portion 415 on the other surface (i.e., a second surface) of the tongue portion 211. Moreover, the insulated member 21 comprises a base portion 24, and the tongue portion 211 is extending from one end of the base portion 24. In this embodiment, a first insulated member 21*a* and a second insulated member 21*b* are integrally formed as a whole and formed as the insulated member 21.

Please refer to FIGS. 1, 2, and 4. In this embodiment, the terminal module 2 comprises a first terminal module 2*a* and a second terminal module 2*b*. The first terminal module 2*a* is assembled by the first insulated member 21*a* and the first receptacle terminals 31. The second terminal module 2*b* is assembled by the second insulated member 21*b*, the shielding plate 7, and the second receptacle terminals 41. Furthermore, the first insulated member 21*a* comprises a terminal positioning portion 22. Body portions 317 of the first receptacle terminals 31 are held by the terminal positioning portion 22, and the terminal positioning portion 22 is formed in the base portion 24.

Please refer to FIGS. 1, 2, and 4. The first terminal module 2*a* is received in the receptacle cavity 112 of the metallic shell 11. The first insulated member 21*a* comprises the tongue portion 211. The tongue portion 211 has two opposite surfaces, one is a first surface 211*a*, and the other is the second surface 211*b*. In addition, a front lateral surface 211*c* of the tongue portion 211 is connected the first surface 211*a* with the second surface 211*b* and is close to the insertion opening 113. In other words, the front lateral surface 211*c* is near the insertion opening 113 and perpendicularly connected to the first surface 211*a* and the second surface 211*b*, respectively.

In this embodiment, the terminal positioning portion 22 and the second receptacle terminals 41 are combined with each other in a first processing procedure. Next, the second insulated member 21*b* is assembled with an assembly of the second receptacle terminals 41 and the terminal positioning portion 22 as well as the shielding plate 7 by insert-molding techniques. In other words, the second terminal module 2*b* is made firstly. Next, the first receptacle terminals 31 are placed on the terminal positioning portion 22. The first receptacle terminals 31 are positioned by a positioning block, so that positions of the first receptacle terminals 31 and distances between adjacent first receptacle terminals 31 are fixed. Moreover, the positioning block is enclosed by the first insulated member 21*a*. Then, after the first receptacle terminals 31 are disposed on the second terminal module 2*b*, the first receptacle terminals 31 and the first insulated member 21*a* are integrally formed with each other to form the first terminal module 2*a*. In other words, in a second processing procedure, the first insulated member 21*a* is formed in the mold and assembled with the second insulated member 21*b* by insert-molding techniques. Thereafter, the first insulated member 21*a* covers on the second insulated member 21*b* and the material band of the terminals is removed. The first insulated member 21*a* and the second insulated member 21*b* are integrally formed with each other, so that the first receptacle terminals 31, the second receptacle terminals 41, the first insulated member 21*a*, and the second insulated member 21*b* can be firmly positioned with each other. Therefore, when the connector is impacted by a foreign force, the components of the connector would not detach from each other easily.

Please refer to FIGS. 1, 2, and 4. In this embodiment, the electrical receptacle connector 100 further comprises a first conductive sheet 61 and a second conductive sheet 62 symmetrical with each other. From a front view of each of the conductive sheets 61, 62, each of the conductive sheets 61, 62 is an elongated sheet having widened U-shaped cross section, and the structure of the first conductive sheet 61 is the same as that of the second conductive sheet 62. The first conductive sheet 61 and the second conductive sheet 62 are respectively on the first insulated member 21*a* and the second insulated member 21*b*. The first conductive sheet 61 has two first contact legs at two sides thereof. The two first contact legs pass through two first through holes of the first insulated member 21*a* and are in contact with two ground terminals 313 which are at two sides of the first receptacle terminals 31, respectively. Conversely, the second conductive sheet 62 has two second contact legs at two sides thereof. The two second contact legs passes through two second through holes of the second insulated member 21*b* and are in contact with two ground terminals 413 which are at two sides of the second receptacle terminals 41. Therefore, the first conductive sheet 61 and the second conductive sheet 62 are respectively in contact with and conducted with the ground terminals 313 of the first receptacle terminals 31 and the ground terminals 413 of the second receptacle terminals 41. The first conductive sheet 61 and the second conductive sheet 62 are respectively in contact with the metallic shell 11. Therefore, when the electrical receptacle connector 100 is mated with an electrical plug connector, a metallic shell of the electrical plug connector is in contact with the first conductive sheet 61 and the second conductive sheet 62, so that the metallic shell of the electrical plug connector and the metallic shell 11 of the electrical receptacle connector 100 can be connected with each other. Accordingly, the connection between the shells of the connectors can be grounded and the electromagnetic interference (EMI) during the signal transmission can be reduced by the first conductive sheet 61 and the second conductive sheet 62.

Please refer to FIGS. 2, 4, and 5. FIG. 5 illustrates a schematic configuration diagram of the receptacle terminals of the electrical receptacle connector shown in FIG. 3. The first receptacle terminals 31 comprise a plurality of first signal terminals 311, a plurality of power terminals 312, and a plurality of ground terminals 313. From a front view of the first receptacle terminals 31, the first receptacle terminals 31 comprise, from left to right, a ground terminal 313 (Gnd), a first pair of first signal terminals 3111 (TX1+−, differential signal terminals for high-speed signal transmission), a power terminal 312 (Power/VBUS), a first function detection terminal 3141 (CC1, a terminal for inserting orientation detection of the connector and for cable recognition), a second pair of first signal terminals 3112 (D+−, differential signal terminals for low-speed signal transmission), a first supplement terminal 3142 (SBU1, a terminal can be reserved for other purposes), another power terminal 312 (Power/VBUS), a third pair of first signal terminals 3113 (RX2+−, differential signal terminals for high-speed signal transmission), and another ground terminal 313 (Gnd). In this embodiment, twelve first receptacle terminals 31 are provided for transmitting USB 3.0 signals. Each pair of the first high-speed signal terminals 3111/3113 is between the corresponding power terminal 312 and the adjacent ground terminal 313. The pair of the first low-speed signal terminals 3112 is between the first function detection terminal 3141 and the supplement terminal 3142.

Furthermore, in some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 2 to 4. The first receptacle terminals 31 are held in the first insulated member 21*a* and formed as the upper-row terminals of the electrical receptacle connector 100. In this embodiment, each of the first receptacle terminals 31 comprises a flat contact portion 315, a body portion 317, and a tail portion 316. For each of the first receptacle terminals 31, the body portion 317 is held in the first insulated member 21*a*, the flat contact portion 315 is extending forward from the body portion 317 in the rear-to-front direction and partly exposed upon the first surface 211*a* of the tongue portion 211, and the tail portion 316 is extending backward from the body portion 317 in the front-to-rear direction and protruding from the rear of the first insulated member 21*a*. The first signal terminals 311 are disposed on the first surface 211*a* and transmit first signals (namely, USB 3.0 signals). The tail portions 316 are extending from the body portions 317 and are bent horizontally to form flat legs, named legs manufactured by SMT (surface mounted technology), which can be mounted or soldered on the surface of a printed circuit board by using surface mount technology. Alternatively, the tail portions 316 may be extending from the body portions 317 downwardly to form vertical legs, named legs manufactured by through-hole technology, which can be inserted into holes drilled in a printed circuit board (PCB). In addition, the overall width of the tail portions 316 is equal to the overall width of the body portions 317. Therefore, the tail portion 316 and the body portion 317 of each of the first receptacle terminals 31 are aligned along the same line, and the distance between two adjacent tail portions 316 correspond the distance between two adjacent contacts 81 of the circuit board 8.

Please refer to FIGS. 2, 4, and 5. The second receptacle terminals 41 comprise a plurality of second signal terminals 411, a plurality of power terminals 412, and a plurality of ground terminals 413. From a front view of the second receptacle terminals 41, the second receptacle terminals 41 comprise, from right to left, a ground terminal 413 (Gnd), a first pair of second signal terminals 4111 (TX2+−, differential signal terminals for high-speed signal transmission), a power terminal 412 (Power/VBUS), a second function detection terminal 4141 (CC2, a terminal for inserting orientation detection of the connector and for cable recognition), a second pair of second signal terminals 4112 (D+−, differential signal terminals for low-speed signal transmission), a second supplement terminal 4142 (SBU2, a terminal can be reserved for other purposes), another power terminals 412 (Power/VBUS), a third pair of second signal terminals 4113 (RX1+−, differential signal terminals for high-speed signal transmission), and another ground terminal 413 (Gnd). In this embodiment, twelve second receptacle terminals 41 are provided for transmitting USB 3.0 signals. Each pair of the second high-speed signal terminals 4111/4113 is between the corresponding power terminal 412 and the adjacent ground terminal 413. The pair of the second low-speed signal terminals 4112 is between the second function detection terminal 4141 and the supplement terminal 4142.

Furthermore, in some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 2, 4, and 5. The second receptacle terminals 41 are held in the second insulated member 21*b* and formed as the lower-row terminals of the electrical receptacle connector 100. The first receptacle terminals 31 are substantially aligned parallel with the second receptacle terminals 41. Each of the second receptacle terminals 41 comprises a flat contact portion 415, a body portion 417, and a tail portion 416. For each of the second receptacle terminals 41, the body portion 417 is held in the second insulated member 21*b* and the tongue portion 211, the flat contact portion 415 is extending from the body portion 417 in the rear-to-front direction and partly exposed upon the second surface 211*b* of the tongue portion 211, and the tail portion 416 is extending backward from the body portion 417 in the front-to-rear direction and protruding from the rear of the second insulated member 21*b*. The second signal terminals 411 are disposed at the second surface 211*b* and transmit second signals (i.e., USB 3.0 signals). In addition, the tail portions 416 are extending from the body portions 417 and bent horizontally to form flat legs, named legs manufactured by SMT (surface mounted technology), which can be mounted or soldered on the surface of a printed circuit board by using surface mount technology. Alternatively, the tail portions 416 may be extending downwardly to form vertical legs, named legs manufactured by through-hole technology, which can be inserted into holes drilled in a printed circuit board (PCB). The tail portions 316 and the tail portions 416 are arranged in a staggered manner from the top view.

Please refer to FIGS. 2 and 3. In some embodiment, the electrical receptacle connector 100 further comprises a shielding plate 7. The shielding plate 7 is between the first terminal module 2*a* and the second terminal module 2*b*. The shielding plate 7 comprises a plate body 71 and a plurality of legs 72. The plate body 71 is between the flat contact portions 315 of the first receptacle terminals 31 and the flat contact portions 415 of the second receptacle terminals 41. In other words, the plate body 71 is integrally formed with the second insulated member 21*b* and between the flat contact portions 315, 415, so that the plate body 71 is assembled on the surface of the second insulated member 21*b*. Specifically, the plate body 71 may be lengthened and widened, so that the front of the plate body 71 is near the front lateral surface 211*c* of the tongue portion 211. Two sides of the plate body 71 is protruding from two sides of the tongue portion 211 for being in contact with an electrical plug connector, and the rear of the plate body 71 is near the rear of the second insulated member 22. Accordingly, the plate body 71 can be disposed on the tongue portion 211 and the second insulated member 21*b*, and the structural strength of the tongue portion 211 and the shielding performance of the tongue portion 211 can be improved.

Please refer to FIGS. 2, 4, and 5. In addition, the legs 72 are extending downward from the rear portion of the shielding plate 7 to form vertical legs. That is, the legs 72 are exposed from the second insulated member 21*b* and in contact with the circuit board 8. In this embodiment, the crosstalk interference can be reduced by the shielding of the shielding plate 7 when the flat contact portions 315, 415 transmit signals. Furthermore, the structural strength of the tongue portion 211 can be improved by the assembly of the shielding plate 7. In addition, the legs 72 of the shielding plate 7 are exposed from the second insulated member 21*b* and in contact with the circuit board 8 for conduction and grounding.

Please refer to FIGS. 2, 4, and 5. The shielding plate 7 further comprises a plurality of hooks 73. The hooks 73 are extending outward from two sides of the plate body 71, and the hooks 73 are protruding from the front lateral surface 211*c* and two sides of the tongue portion 211. When an electrical plug connector is mated with the electrical receptacle connector 100, elastic pieces at two sides of an insulated housing of the electrical plug connector are engaged with the hooks 73, and the elastic pieces would not wear against the tongue portion 211 of the electrical receptacle connector 100. Hence, the shielding plate 7 can be in contact with the metallic shell of the plug connector for conduction and grounding.

Please refer to FIGS. 2, 4, and 5. In this embodiment, the first receptacle terminals 31 and the second receptacle terminals 41 are disposed upon the first surface 211*a* and the second surface 211*b* of the tongue portion 211, respectively, and pin-assignments of the first receptacle terminals 31 and the second receptacle terminals 41 are point-symmetrical with a central point of the receptacle cavity 112 as the symmetrical center. In other words, pin-assignments of the first receptacle terminals 31 and the second receptacle terminals 41 have 180-degree symmetrical design with respect to the central point of the receptacle cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 211*a* is facing up, for transmitting first signals. Conversely, the electrical plug connector is inserted into the electrical receptacle connector 100 with a second orientation where the first surface 211*a* is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of the first signal terminals 3111 (TX1+−) and the third pair of the first signal terminals 3113 (RX2+−) are omitted, and the second pair of the first signal terminals 3112 (D+−) and the power terminals 312 (Power/VBUS) are retained. While for the second receptacle terminals 41 in accordance with transmission of USB 2.0 signals, the first pair of the second signal terminals 4111 (TX2+−) and the third pair of the second signal terminals 4113 (RX1+−) are omitted, and the second pair of the second signal terminals 4112 (D+−) and the power terminals 412 (Power/VBUS) are retained.

Figure 6A:
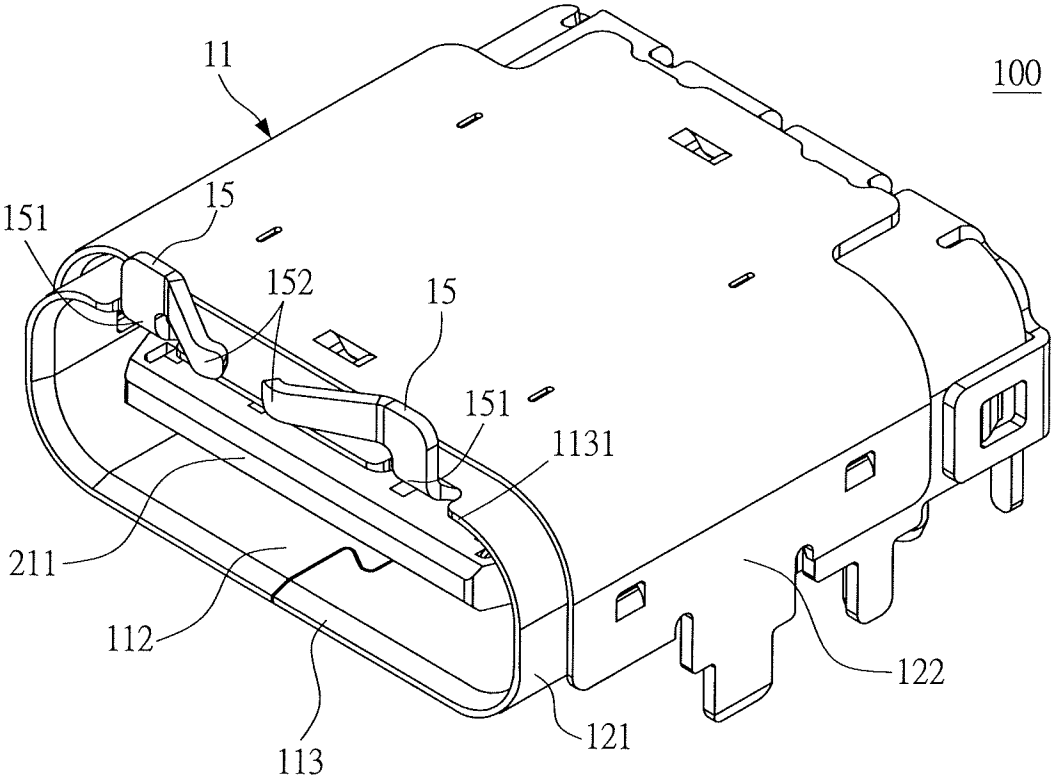
FIG. 6A illustrates a perspective view of an electrical receptacle connector of a second embodiment of the instant disclosure.

Please refer to FIG. 6A, illustrating an electrical receptacle connector of a second embodiment of the instant disclosure. FIG. 6A illustrates a perspective view of the electrical receptacle connector of the second embodiment. In this embodiment, the electrical receptacle connector 100 further comprises a plurality of contact arms 15. The contact arms 15 are spacedly aligned on an end edge 1131 of the insertion opening 113. Each of the contact arms 15 comprises one supporting portion 151. The supporting portions 151 are at two sides of the end edge 1131 of the insertion opening 13. Each of the contact surfaces 152 is extending from the corresponding supporting portion 151, and the contact surfaces 152 are bent toward each other.

In the second embodiment, when the electrical receptacle connector 100 is assembled in the housing 91 of the electronic device 9 (e.g., a mobile phone or a notebook computer), the contact arms 15 are in contact with the inner wall of the housing 91, and the contact arms 15 have a force adapted to maintain the contact after the contact arms 15 are in contact with the inner wall of the housing 91, and the conduction path between the housing 91 and the connector 100 increases. Therefore, the contact surfaces 152 are conducted with the inner wall of the housing 91 for grounding, thereby improving the performance of electromagnetic compatibility (EMC).

In the foregoing embodiment, the contact arms 15 are disposed on the inner shell 121 and are spacedly aligned on the end edge 1131 of the insertion opening 113, but embodiments are not limited thereto. In one embodiment, as shown in FIG. 6B, the contact arms 15 are on one side of the cover shell 122; specifically, the contact arms 15 may be disposed on the cover shell 122, and the contact arms 15 are spacedly aligned on an end edge 1221 of the cover shell 122.

In one embodiment, as shown in FIG. 7A, illustrating an electrical receptacle connector of a third embodiment of the instant disclosure. FIG. 7A illustrates a perspective view of the electrical receptacle connector of the third embodiment. In this embodiment, the contact arms 15 are on one side of the cover shell; specifically, the contact arms 15 are spacedly aligned on an outer surface of the cover shell 122. In the case that the contact arms 15 are configured on the cover shell 122, the contact arms 15 can be manufactured easily, next, the cover shell 122 and the inner shell 121 are soldered integrally by laser soldering. Accordingly, when the electrical receptacle connector 100 is assembled in the housing 91 of the electronic device 9 (e.g., a mobile phone or a notebook computer), the contact arms 15 are in contact with the inner wall of the housing 91 and the contact arms have a force adapted to maintain the contact after the contact arms are in contact with the inner wall of the housing, and the conduction path between the housing 91 and the connector 100 increases. Therefore, the contact surfaces 152 are conducted with the inner wall of the housing 91 for grounding, thereby improving the performance of electromagnetic compatibility (EMC).

In the foregoing embodiment, the contact arms 15 are spacedly aligned on the outer surface of the cover shell 122, but embodiments are not limited thereto. In one embodiment, as shown in FIG. 7B, the contact arms 15 are on one side of the cover shell 122; specifically, the contact arms 15 are disposed on the end edge 1221 of the cover shell 122. The supporting portion 151 of each of the contact arms 15 is extending outward from the end edge 1221 of the cover shell 122 and folded reversely, so that the contact surface 152 is extending from the supporting portion 151 and above the outer surface of the cover shell 122. Upon the manufacturing, the end edge 1221 of the cover shell 122 has reserved portions for manufacturing the contact arms 15, and the reserved portion can be folded to form the contact arms 15. Therefore, different manufacturing procedures can be applied for forming the contact arms 15. Conversely, in FIG. 7A, the contact arms 15 are portions each extending from a periphery of a cut hole on the outer surface of the cover shell 122, and the portions are bent (e.g., a part of the outer surface of the cover shell 122 is cut to form the contact arm 15 and the cut hole).

Figure 8:
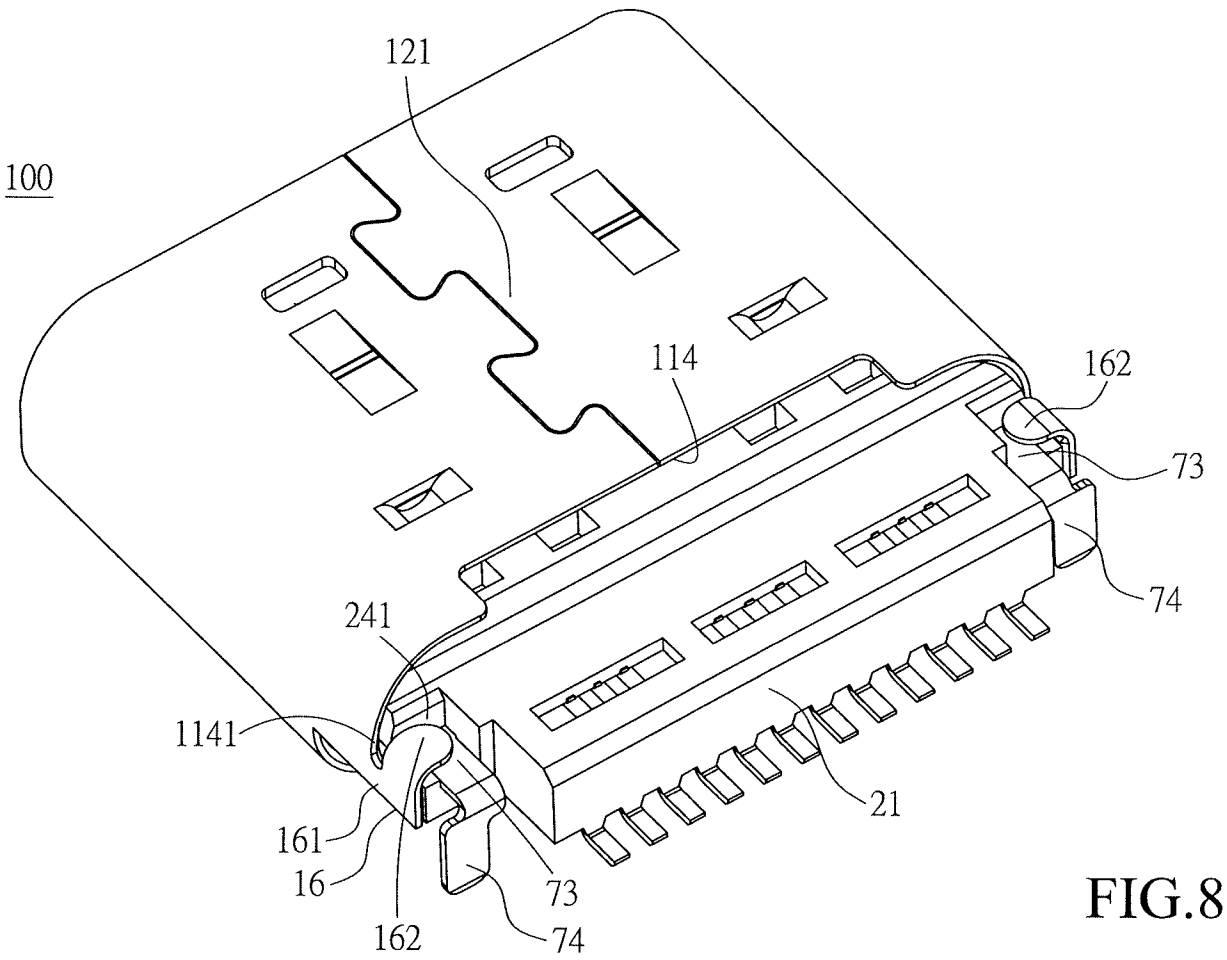
FIG. 8 illustrates a perspective view of an electrical receptacle connector of a fourth embodiment of the instant disclosure.
Figure 9:
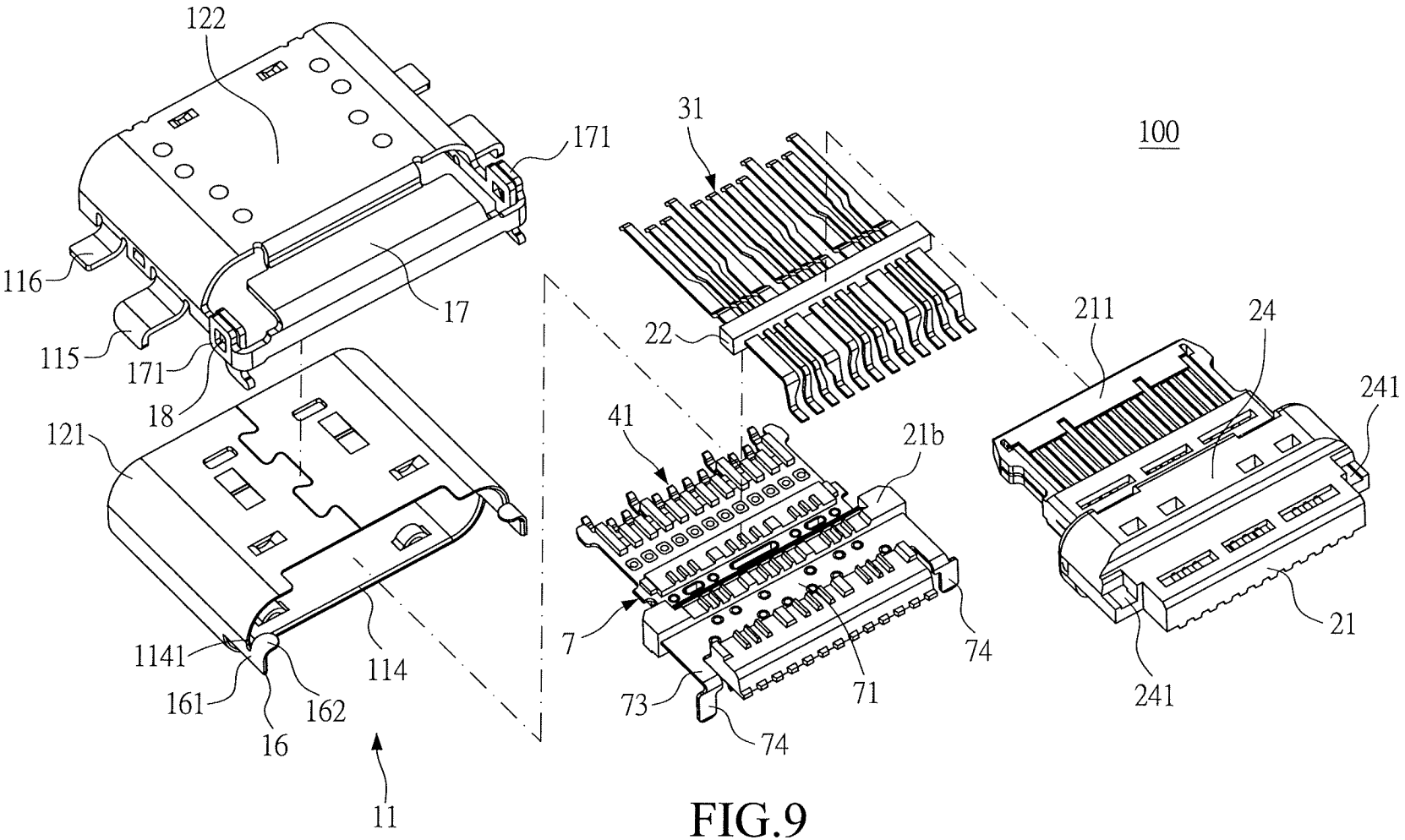
FIG. 9 illustrates an exploded view of the electrical receptacle connector of the fourth embodiment.

Please refer to FIGS. 8 and 9, illustrating an electrical receptacle connector of a fourth embodiment of the instant disclosure. FIG. 8 illustrates a perspective view of the electrical receptacle connector of the fourth embodiment in which the cover shell is not shown. FIG. 9 illustrates an exploded view of the electrical receptacle connector of the fourth embodiment. In the fourth embodiment, the legs 74 of the shielding plate 7 are in contact with buckling sheets 16 of the metallic shell 11, and the legs 74 are soldered with the circuit board 8 for grounding, thereby improving the performance of electromagnetic compatibility.

In detail, in this embodiment, the terminal module 2 comprises a plurality of buckling grooves 241 formed at two sides of the insulated member 21. The shielding plate 7 further comprises a plurality of contact parts 73 respectively extending toward the buckling grooves 241 and a plurality of legs 74 respectively extending outward from the contact parts 73. In addition, the metallic shell 11 comprises a plurality of buckling sheets 16. Each of the buckling sheets 16 comprises an extension portion 161 and a contact sheet 162. The extending portions 161 are extending toward the buckling grooves 241 from two sides of the shell body 111. The contact sheets 162 are extending toward the buckling grooves 241 from the extension portions 161. The contact sheets 162 are in contact with the contact parts 73, respectively. In this embodiment, the inner shell 121 comprises an insertion opening 113 and a rear opening 114. The buckling sheets 16 are on an end edge 1141 of the rear opening 114.

When the metallic shell 11 encloses the insulated member 21, the contact sheets 162 are bent, so that an angle between each of the contact sheets 162 and the corresponding extension portion 161 is about 90 degrees. Hence, the contact sheets 162 are engaged with the buckling grooves 241 for positioning the insulated member 21, so that the insulated member 21 does not detach form the metallic shell 11. Furthermore, the contact sheets 162 are in contact with the contact parts 73, and end portions of the legs 74 are soldered with the circuit board 8 for grounding, thereby improving the performance of electromagnetic compatibility.

Please refer to FIG. 9. The metallic shell 11 further comprises a plurality of extension sheets 116 extending outward from two sides of the shell body 111. The extension sheets 116 are adjacent to the insertion opening 113 and located at the front sides of the conductive legs 115. In this embodiment, the electrical receptacle connector 100 is assembled at a crack (not shown) of the circuit board 8. In other words, the electrical receptacle connector 100 is assembled with the circuit board 8 by sinking technique. The conductive legs 115 are soldered with the contacts 81 of the circuit board 8, and the extension sheets 116 are attached on a surface of the circuit board 8. Furthermore, the extending sheets 116 may be fixed on a soldering plate of the circuit board 8 by soldering. Therefore, the electrical receptacle connector 100 would not be deflected upon the electrical receptacle connector is mated with an electrical plug connector and abutted against the electrical plug connector, as well as the grounding between the electrical receptacle connector 100 and the circuit board 8 can be further improved.

Figure 10:
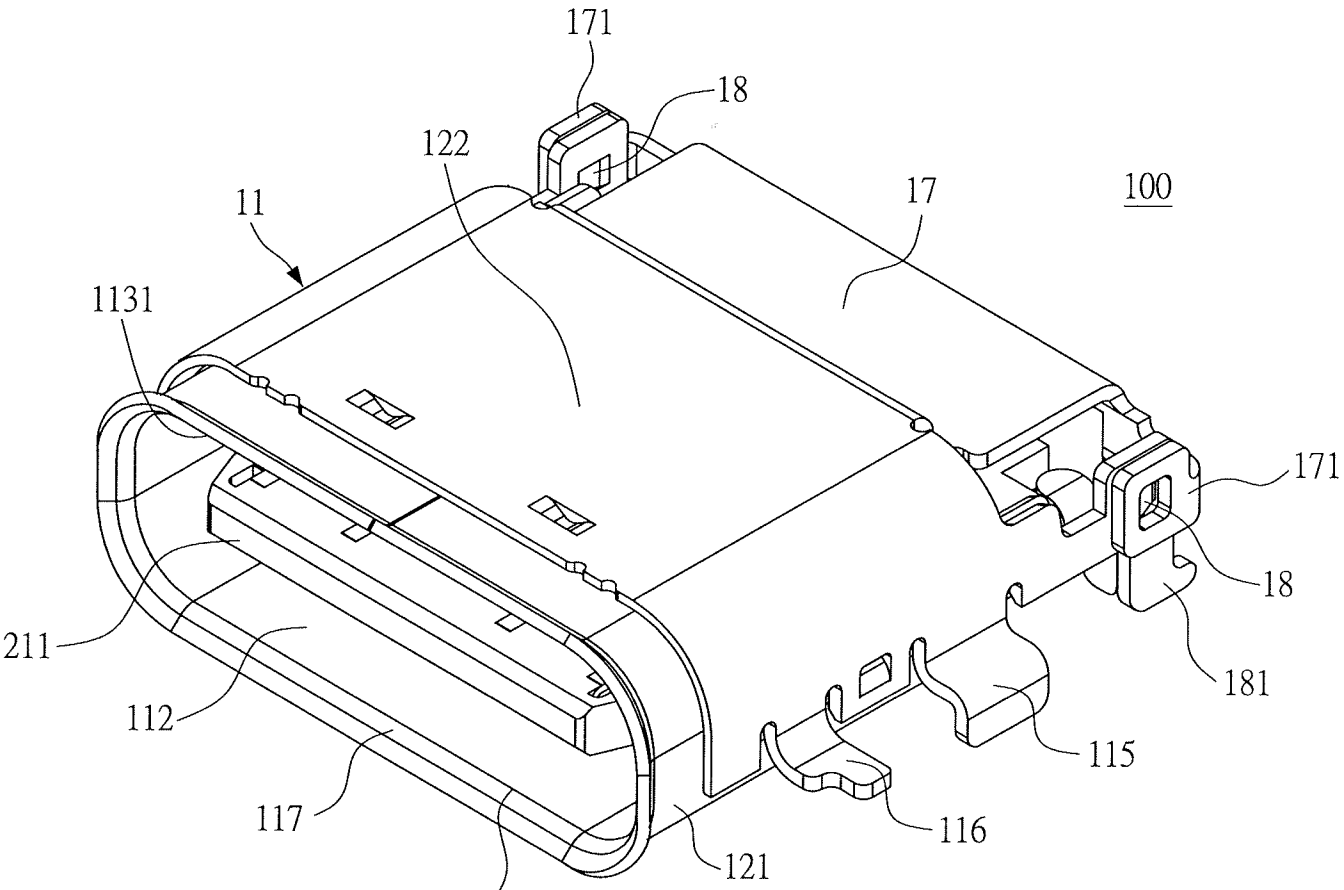
FIG. 10 illustrates a perspective view of one embodiment of the electrical receptacle connector with a guiding portion.

Please refer to FIGS. 9 and 10. The metallic shell 11 further comprises a rear cover 17, two ear portions 171, and two engaging sheets 18. The two engaging sheets 18 are extending outward from two sides of the shell body 111. The two ear portions 171 are extending from two sides of the rear cover 17 and bent. The two ear portions 171 are engaged with the two engaging sheets 18. Therefore, the rear cover 17 does not detach from the shell body 111, and the metallic shell 11 can be firmly assembled with the circuit board 8. In addition, each of the two engaging sheets 18 comprises an engaging portion 181 adapted to be engaged with an engaging hole (not shown) of the circuit board 8, and the engaging portions 181 may be electrically connected to the circuit board 8 for improving the conduction and grounding. Accordingly, the fixation of the electrical receptacle connector 100 can be further improved, and the electrical receptacle connector 100 does not deflect downward when the electrical receptacle connector 100 is mated with an electrical plug connector.

As above, the contact arms are in contact with the inner wall of the housing, and the contact arms have a force adapted to maintain the contact after the contact arms are in contact with the inner wall of the housing, so that the contact surfaces are conducted with the inner wall of the housing of the electronic device for grounding, thereby improving the performance of electromagnetic compatibility. Furthermore, the metallic shell comprises the conductive legs extending outward from two sides of the shell body and respectively connected to the contacts of the circuit board. The metallic shell may be electrically connected to an electrical plug connector and the connection can be grounded by the housing and the circuit board. Moreover, when the metallic shell encloses the insulated member, the contact sheets are bent, so that the angle between each of the contact sheets and the corresponding contact portion is approximately 90 degrees. Hence, the contact sheets are engaged with the buckling grooves for positioning the insulated member, so that the insulated member does not detach from the metallic shell. Additionally, the contact sheets are in contact with the legs, and end portions of the legs are soldered with the circuit board for grounding, thereby improving the performance of electromagnetic compatibility.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a terminal module comprising a plurality of first receptacle terminals, a plurality of second receptacle terminals, and an insulated member, wherein the first receptacle terminals, the second receptacle terminals, and the insulated member are formed integrally, a tongue portion is extending from one end of the insulated member, each of the first receptacle terminals comprises a first flat contact portion on one of two opposite surfaces of the tongue portion, each of the second receptacle terminals comprises a second flat contact portion on the other surface of the tongue portion;

a shielding plate embedded inside the insulated member and between the first flat contact portions and the second flat contact portions; and a metallic shell comprises an inner shell, a cover shell, and a contact arm, wherein the metallic shell comprises a receptacle cavity for receiving the terminal module, the inner shell comprises an insertion opening communicating with the receptacle cavity, the cover shell covers the inner shell, and the contact atm is on one side of the cover shell, the contact arm comprises a supporting portion and a plurality of contact surfaces, the support portion is extending outward from the an end edge of the insertion opening of the inner shell, the contact surfaces are bent outward from two sides of the supporting portion, and the contact surfaces are extended toward different directions, respectively.

2. The electrical receptacle connector according to claim 1, wherein the inner shell is a tubular member and fitted over the terminal module.

3. The electrical receptacle connector according to claim 1, further comprising a circuit board, wherein the circuit board comprises a plurality of contacts, the metallic shell comprises a plurality of conductive legs extending outward from two sides of the inner shell and connected to the contacts, respectively.

4. The electrical receptacle connector according to claim 3, wherein the metallic shell further comprises a plurality of extension sheets extending outward from the two sides of the shell body and attached on a surface of the circuit board.

5. The electrical receptacle connector according to claim 1, wherein the metallic shell further comprises a guiding portion surrounding an end edge of the insertion opening, the guiding portion is bent and extending outward.

6. The electrical receptacle connector according to claim 1, wherein the metallic shell further comprises a rear cover, two ear portions, and two engaging sheets, the two engaging sheets are extending outward from two sides of the inner shell, the two ear portions are extending from two sides of the rear cover, and the two ear portions are bent, and engaged with the two engaging sheets, respectively.

7. An electrical receptacle connector, comprising:

a terminal module comprising a plurality of first receptacle terminals, a plurality of second receptacle terminals, and an insulated member, wherein the first receptacle terminals, the second receptacle terminals, and the insulated member are formed integrally, a tongue portion is extending from one end of the insulated member, each of the first receptacle terminals comprises a first flat contact portion on one of two opposite surfaces of the tongue portion, each of the second receptacle terminals comprises a second flat contact portion on the other surface of the tongue portion;

a shielding plate embedded inside the insulated member and between the first flat contact portions and the second flat contact portions; and a metallic shell comprises an inner shell, an cover shell, and a plurality contact arms, wherein the metallic shell comprises a receptacle cavity for receiving the terminal module, the inner shell comprises an insertion opening communicating with the receptacle cavity, the cover shell covers the inner shell, each of the contact arm comprises a supporting portion and a contact surfaces, the contact arms are spacedly aligned on an outer surface of the cover shell, the supporting portions of the contact arms are bent outward from the outer surface of the cover shell, and the contact surfaces are extending outward from the supporting portion.

8. The electrical receptacle connector according to claim 7, wherein the supporting portion of each of the contact arms is extending outward from the end edge of the cover shell and folded reversely, and the contact surface of each of the contact arms is extending from the support portion and above the outer surface of the cover shell.

9. An electrical receptacle connector, comprising:

a terminal module comprising a plurality of first receptacle terminals, a plurality of second receptacle terminals, an insulated member, and a plurality of buckling grooves, wherein the first receptacle terminals, the second receptacle terminals, and the insulated member are formed integrally, a tongue portion is extended from one end of the insulated member, each of the first receptacle terminals comprises a first flat contact portion on one of two opposite surfaces of the tongue portion, each of the second receptacle terminals comprises a second flat contact portion on the other surface of the tongue portion, the buckling grooves are formed on two sides of the insulated member;

a shielding plate embedded inside the insulated member and between the first flat contact portions and the second flat contact portions, wherein the shielding plate comprises a plurality of contact parts respectively extending toward the buckling grooves and a plurality of legs respectively extending outward from the contact parts; and a metallic shell comprises a shell body and a plurality of buckling sheets, wherein the metallic shell comprises a receptacle cavity for receiving the terminal module, each of the buckling sheets comprises an extension portion and a contact sheet, the extension portions are extending toward the buckling grooves from two sides of the shell body, the contact sheets are extending toward the buckling grooves from the extension portions, respectively, and the contact sheets are in contact with the contact parts, respectively.

10. The electrical receptacle connector according to claim 9, wherein the shell body is an inner shell and the electrical receptacle connector further comprises a cover shell, the inner shell is a tubular member and fitted over the terminal module, the inner shell comprises an insertion opening communicating with the receptacle cavity and a rear opening, the cover shell covers the inner shell, the buckling sheets are on an end edge of the rear opening.

11. The electrical receptacle connector according to claim 10, wherein the metallic shell further comprises a guiding portion surrounding an end edge of the insertion opening, the guiding portion is bent and extending outward.

12. The electrical receptacle connector according to claim 9, further comprising a circuit board, wherein the circuit board comprises a plurality of contacts, the legs are connected to the contacts, respectively.

13. The electrical receptacle connector according to claim 12, wherein the metallic shell further comprises a plurality of extension sheets extending outward from the two sides of the shell body and attached on a surface of the circuit board.

14. The electrical receptacle connector according to claim 9, wherein the metallic shell further comprises a rear cover, two ear portions, and two engaging sheets, the two engaging sheets are extending outward from two sides of the shell body, the two ear portions are extending from two sides of the rear cover, and the two ear portions are bent, and engaged with the two engaging sheets, respectively.

* * * * *